US009662561B1

(12) United States Patent
Valenti

(10) Patent No.: US 9,662,561 B1
(45) Date of Patent: May 30, 2017

(54) BASEBALL/SOFTBALL GLOVE

(71) Applicant: Ronald J. Valenti, Bakersfield, CA (US)

(72) Inventor: Ronald J. Valenti, Bakersfield, CA (US)

( * ) Notice: Subject to any disclaimer, the term of this patent is extended or adjusted under 35 U.S.C. 154(b) by 0 days.

(21) Appl. No.: 15/232,206

(22) Filed: Aug. 9, 2016

(51) Int. Cl.
*A63B 71/14* (2006.01)
*A41D 19/015* (2006.01)
*A63B 102/18* (2015.01)

(52) U.S. Cl.
CPC ..... *A63B 71/143* (2013.01); *A41D 19/01523* (2013.01); *A41D 2300/50* (2013.01); *A63B 2102/182* (2015.10)

(58) Field of Classification Search
CPC ..... A63B 71/143
USPC ..... 2/19, 161.1, 159
See application file for complete search history.

(56) References Cited

U.S. PATENT DOCUMENTS

D207,089 S 3/1967 Bates
4,192,018 A * 3/1980 Latina ..... A63B 71/143 2/19
5,253,365 A 10/1993 Clevenhagen
5,799,327 A * 9/1998 Clevenhagen ..... A63B 71/143 2/19
6,182,289 B1 * 2/2001 Brown ..... A63B 71/143 2/161.1
2008/0060104 A1 * 3/2008 Lin ..... A63B 71/143 2/19
2009/0007307 A1 * 1/2009 Le ..... A63B 71/143 2/19
2011/0083242 A1 * 4/2011 Laliberty ..... A63B 71/143 2/19
2011/0113521 A1 * 5/2011 Bradford ..... A41D 19/01582 2/19
2013/0167281 A1 * 7/2013 Jennings ..... A63B 71/143 2/19

* cited by examiner

*Primary Examiner* — Gloria Hale
(74) *Attorney, Agent, or Firm* — James M. Duncan, Esq.; Klein DeNatale Coldner

(57) ABSTRACT

A glove for baseball and softball is configured from joining a first panel and a second panel to form a glove shell. The glove shell has a thumb stall, a first finger stall, and a second finger stall. A notch extends upwardly from the heel of the glove. A palm section is divided into two portions, where a flexible seam extends between the two portions, where the flexible seam will be fabricated from a flexible material Any underlying padding in the palm section will also be divided by the flexible seam. A web member extends upwardly from the palm section. The web member is divided into two panels, where the two panels are joined by a flexible connecting member.

7 Claims, 1 Drawing Sheet

BASEBALL/SOFTBALL GLOVE

BACKGROUND OF THE INVENTION

The presently disclosed invention relates generally to equipment used for playing baseball and softball (collectively referred to hereinafter as "baseball") and more particularly to a glove which may be utilized by new players to the game to facilitate the catching of a ball within the glove. The present invention may be particularly helpful to young persons and persons with limited hand strength.

A new player can be easily frustrated in trying to learn how to catch a ball by the difficulty presented in trying to catch a ball with a glove which is stiff and difficult to close with a small hand, or a hand with limited strength. Moreover, a ball coming in with significant velocity can present a risk to the player and others if the player is unable to adequately secure the ball within the glove or use correct techniques in guiding the ball into the glove.

The basic components of a baseball glove are the heel, the finger stalls (or fingers), the hinge, the pocket, the webbing, and the back. The hinge is where the finger stalls meet the palm of the glove. The webbing connects the thumb stall to an adjacent finger stall. The webbing helps snag and hold onto the ball. The pocket of the glove is the indentation in the palm where the ball should drop after it has been caught. The back of the glove includes the wrist closure, which may be either open back or closed back.

As known by those who have experience in playing baseball, new baseball gloves present a particular challenge, even to experienced players. A new glove is typically stiff and requires significant breaking in or conditioning so that the glove will close easily along a flex line in the glove which begins at the bottom of the glove and generally extends diagonally across the pocket of the glove toward the web at the top of the glove. There are two parts of a glove which are hardest to flex initially—at the hinge and the web at the top of the pocket. A number of methods of breaking in a glove have been practiced. Glove manufacturers offer a variety of different oils or creams to soften the leather. Among other practices, people have attempted to break in new gloves by pounding the glove with a mallet, running over the glove with a car, storing the glove under a mattress or even heating it in the oven. The goal is to make the hinge and the web soft and pliable. However, nothing breaks in a glove faster than using it, which presents a dilemma for young and new players who don't have the hand strength and acquired technique to use a new glove.

SUMMARY OF THE INVENTION

Embodiments of the present invention present a solution to the problem described above by providing a glove which requires little or no breaking in, and which is easily closeable by a person with limited hand strength because the glove is essentially self-closing.

An embodiment of the presently disclosed glove has a first panel forming a palm side wall of the glove and a second panel forming a backside wall of the glove. The first panel and the second panel are secured together along a peripheral margin of each panel to form a glove shell, where the glove shell has a top, a bottom, and opposite sides. A thumb stall is defined within the glove shell, where the thumb stall receives a thumb of the hand of a user. Two finger stalls, a first finger stall and a second finger stall, are also defined within the glove shell. Unlike prior art gloves, the presently disclosed glove has only two finger stalls in addition to the thumb stall Each of the two finger stalls is adapted to receive two fingers of the hand of a user. Typically, the user will insert the user's index finger and middle finger in the first finger stall, and the user's ring finger and little finger in the second finder stall.

An embodiment of the disclosed glove also has a heel at the bottom of the palm side wall of the glove, where a notch extends upwardly from the heel, where the notch would be approximately adjacent to the wrist of a user. A palm section extends upwardly towards the fingers from the heel. The palm section is divided into a thumb side portion and a finger side portion, where each portion is approximately half of the total palm section. Any padding material in the palm section will also be divided into a palm side portion and a finger side portion.

A web member is located between the thumb stall and the first finger stall. The web member is divided into having a thumb side panel and a finger side panel, where the thumb side panel and the finger side panel are attached by a flexible connecting member, such as a length of leather lace.

A flexible seam extends from the notch and through the palm section, the flexible seam connecting the finger side portion to the thumb side portion. The flexible seam is not underlain by any padding material, but divides the palm side padding and the finger side padding, if present. The flexible seam may be fabricated from a variety of materials, such nylon webbing or like material.

Leather lacing will typically extend across the top of the glove shell connecting, in sequence, the thumb stall, the web member, the first finger stall and the second finger stall. The glove shell itself will be fabricated from leather or other animal hide materials known to be used for fabricating baseball gloves.

DETAILED DESCRIPTION OF THE INVENTION

Figure 1:
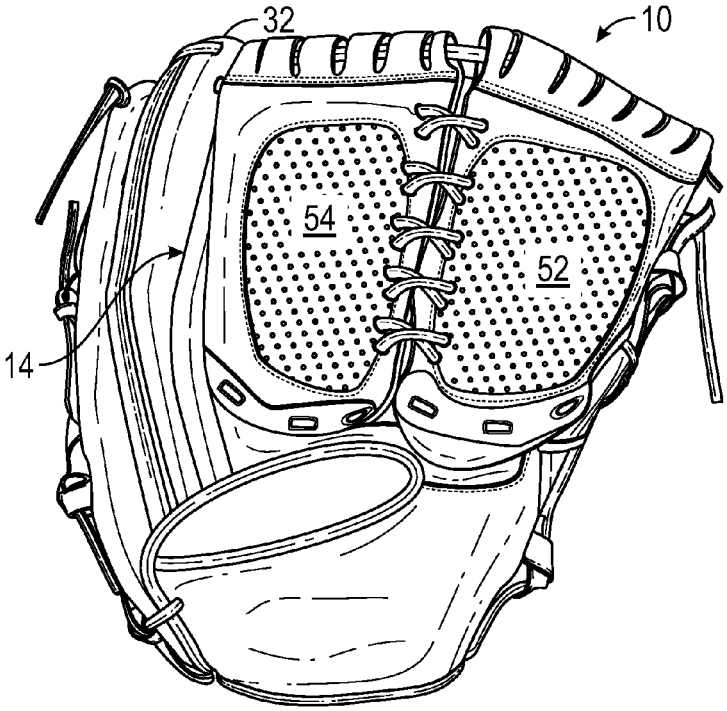
FIG. 1 depicts a back view of an embodiment of the present invention.
Figure 2:
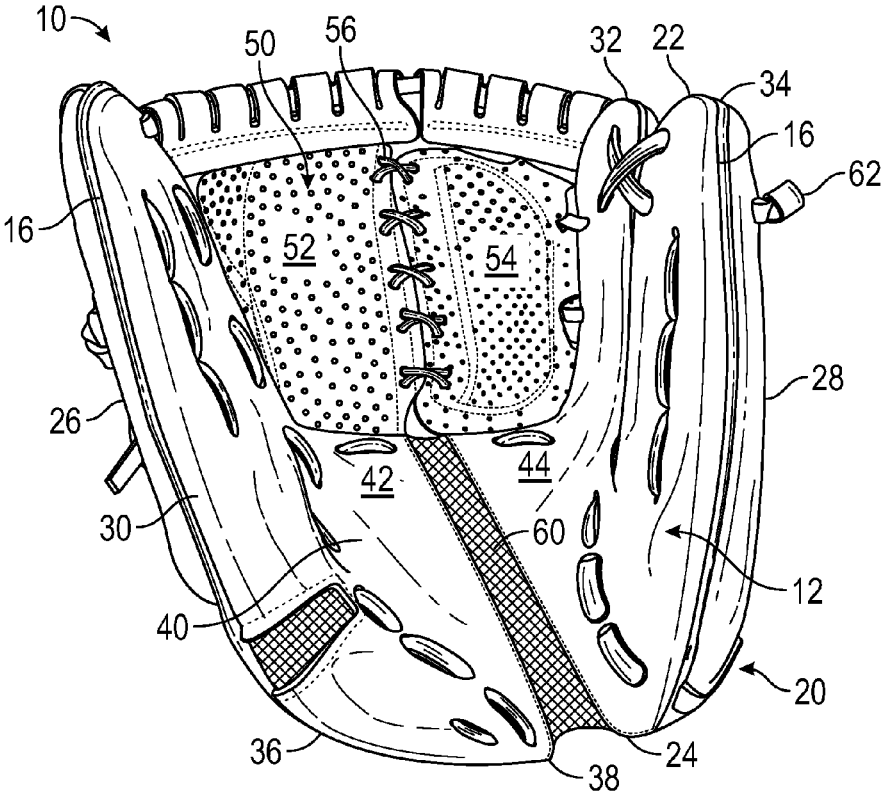
FIG. 2 depicts a front view of an embodiment of the present invention.

Referring now to the drawings, FIGS. 1 and 2 depict an embodiment of the disclosed baseball glove 10. It is be noted that terms which are indicative of direction, such as "upwardly,", "downwardly", "front", "back", etc., are made with respect to the orientations depicted in the figures, and are not intended in any way to limit the claimed invention.

A first panel 12 forms a palm side wall of the glove 10 while a second panel 14 forms a backside wall of the glove. The first panel 12 and the second panel 14 are secured together along a peripheral margin 16 of each panel to form a glove shell 20 having a top 22, a bottom 24 and opposite sides 26, 28. A thumb stall 30 is defined within the glove shell 20 for receiving a thumb of the hand of a user.

A first finger stall 32 and a second finger stall 34 are also defined within the glove shell 20. The first finger stall 32 and the second finger stall 34 are each adapted to receive two fingers of a hand of a user. Typically, the user will insert the user's index finger and middle finger in first finger stall 32 and the user's ring finger and small finger in the second finger stall 34.

The glove 10 also has a heel 36 at the bottom 24 of the palm side wall of the glove. A palm section 40 extends from the heel 36, where the palm section has a thumb side portion 42 and a finger side portion 44. A web member 50 extends upwardly from the palm section 40. The web member 50 spans between the thumb stall 30 and the first finger stall 32. The web member 50 has a thumb side panel 52 and a finger side panel 54, where the thumb side panel and the finger side panel are attached by a flexible connecting member 56, such as leather lacing. Padding material may be disposed inside the glove shell 20 beneath the thumb side panel 52 and the finger side panel 54, where the padding material is divided by the flexible seam.

A notch 38 is formed in the heel 36. A flexible seam 60 extends from the notch 38 and through the palm section 40 and may extend up to the web member 50. The flexible seam 60 connects the finger side portion 44 to the thumb side portion 42 of the palm section 40, where the flexible seam acts as a hinge for closure of the glove.

As shown in the figures, leather lacing 62 will typically extend across the top 22 of the glove shell 20 connecting, in sequence, the thumb stall 30, the web member 50, the first finger stall 32 and the second finger stall 34.

Having thus described the preferred embodiment of the invention, what is claimed as new and desired to be protected by Letters Patent includes the following:

1. A baseball glove comprising:

a first panel forming a palm side wall of the glove;

a second panel forming a backside wall of the glove, said first panel and second panel being secured together along a peripheral margin of each panel to form a glove shell having a top, a bottom and opposite sides;

a thumb stall defined within the glove shell for receiving a thumb of the hand of a user;

a plurality of finger stalls defined within the glove shell, the plurality having a total limited to no more than two finger stalls comprising a first finger stall and a second finger stall, the first finger stall and the second finger stall each adapted to receive two fingers of a hand of a user;

a heel at the bottom of the palm side wall of the glove;

a palm section extending from the heel, the palm section having a thumb side portion and a finger side portion;

a web member extending from the palm section, the web member located between the thumb stall and the first finger stall, the web member having a thumb side panel and a finger side panel, the thumb side panel and the finger side panel attached by a flexible connecting member;

and a flexible seam extending from the heel and through the palm section, the flexible seam connecting the finger side portion to the thumb side portion.

2. The baseball glove of claim 1 wherein the heel comprises a notch.

3. The baseball glove of claim 2 wherein the flexible seam extends from the notch.

4. The baseball glove of claim 1 wherein the flexible connecting member comprises leather lacing.

5. The baseball glove of claim 1 wherein the flexible seam comprises nylon mesh.

6. The baseball glove of claim 1 further comprising padding material disposed inside the glove shell, the padding beneath the thumb side portion and the finger side portion, wherein the padding is divided by the flexible seam.

7. The baseball glove of claim 3 wherein the flexible seam extends from the notch up to the web member.

* * * * *